US006347955B1

(12) United States Patent
Huang

(10) Patent No.: US 6,347,955 B1
(45) Date of Patent: Feb. 19, 2002

(54) ELECTRICAL CONNECTOR HAVING LATCHES

(75) Inventor: Nan Tsung Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/664,880

(22) Filed: Sep. 19, 2000

(30) Foreign Application Priority Data

Jun. 3, 2000 (TW) ..... 089209521

(51) Int. Cl.[7] ..... H01R 13/629
(52) U.S. Cl. ..... 439/378; 439/357
(58) Field of Search ..... 439/378, 607–610, 439/350, 353, 356, 357

(56) References Cited

U.S. PATENT DOCUMENTS 5,634,810 A * 6/1997 Niitsu et al. ..... 439/378
5,885,088 A * 3/1999 Brennan et al. ..... 439/378
6,007,364 A * 12/1999 Wu ..... 439/378
6,074,235 A * 6/2000 Brandberg et al. ..... 439/378
6,074,236 A * 6/2000 Wu ..... 439/378
6,093,046 A * 7/2000 Chiou et al. ..... 439/378

* cited by examiner

*Primary Examiner*—Gary F. Paumen
(74) *Attorney, Agent, or Firm*—Wei Te Chung

(57) ABSTRACT

An electrical connector includes an insulative housing having a plurality of passageways for receiving a plurality of terminals therein, a shield enclosing a forwardly projecting tongue of the insulative housing, two grounding plates attached to a rear side of the insulative housing for enhancing grounding performance, a bracket for supporting the insulative housing, and two latches. Each latch has a retaining portion and a coupling portion. The retaining portion engages with the insulative housing. The coupling portion has two resilient arms for guiding and retaining a complementary connector in a mated position with the electrical connector. The retaining portion includes a baffle, an engaging section and a securing section, wherein the diameter of the securing section is smaller than that of the engaging section. The insulative housing further defines two through holes at opposite ends for extension of the securing section of the latch therethrough. In assembly, the retaining portions of the latches extend through and are engaged with the bracket, the insulative housing and the grounding plates. During mating with the complementary connector, the resilient arms of the latches help guide the electrical connector and keep it securely fastened to the complementary connector.

1 Claim, 4 Drawing Sheets

ELECTRICAL CONNECTOR HAVING LATCHES

BACKGROUND OF THE INVENTION

1. Field of the Invention

The present invention relates to an electrical connector, and particularly to an electrical connector having latches for guiding and retaining a complementary connector in a mated position and also for facilitating assembly of the components of the electrical connector.

2. Description of the Prior Art

U.S. Pat. No. 6,007,364 discloses an electrical connector having a housing with two forwardly projecting guide aims integrally formed thereon. The guide arms guide a complementary connector into a mated position with the electrical connector. However, such guide arms only function as a guiding means. To secure the components of the electrical connector together, additional securing means, such as sets of screws and nuts are required. This increases the number of components of the connector, and also makes the process of assembling the connector more complicated. Hence, an improved electrical connector is required to overcome the disadvantages of the prior art.

BRIEF SUMMARY OF THE INVENTION

A main object of the present invention is to provide an electrical connector having latches for guiding and retaining a complementary connector in a mated position with the electrical connector;

Another object of the present invention is to provide an electrical connector having latches which reduce the number of the components of the connector and simplify the process of assembling the connector.

To achieve the above objects, an electrical connector assembly in accordance with the present invention comprises an insulative housing having a plurality of passageways for receiving a plurality of terminals therein, a shield enclosing a forwardly projecting tongue of the insulative housing, two grounding plates attached to a rear side of the insulative housing for enhancing grounding performance, a bracket for supporting the insulative housing, and two latches. Each latch has a retaining portion and a coupling portion. The retaining portion engages with the insulative housing. The coupling portion has two resilient arms for guiding and retaining a complementary connector in a mated position with the electrical connector. The retaining portion comprises a baffle, an engaging section and a securing section, wherein the diameter of the securing section is smaller than that of the engaging section. The insulative housing further defines two through holes at opposite ends for insertion of the securing section of the latch therethrough. In assembly, the securing sections of the latches extend through and are engaged with the bracket, the insulative housing and the grounding plate. During mating with the complementary connector, the resilient arms of the latches help guide and retain engagement of the complementary connector.

Other objects, advantages and novel features of the invention will become more apparent from the following detailed description of the present embodiment when taken in conjunction with the accompanying drawings.

DETAILED DESCRIPTION OF THE INVENTION

Figure 1:
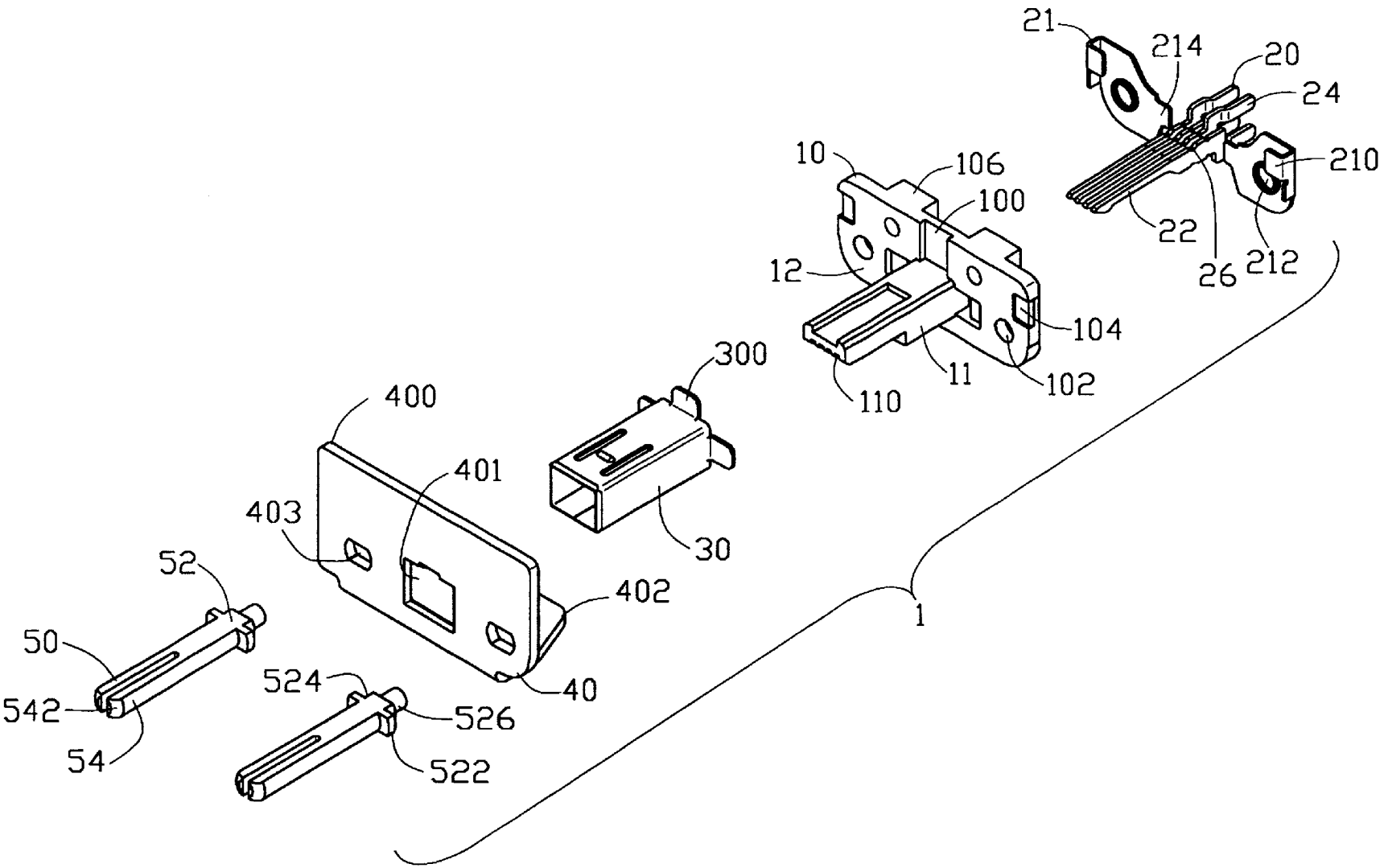
FIG. 1 is an exploded view of an electrical connector in accordance with the present invention.
Figure 2:
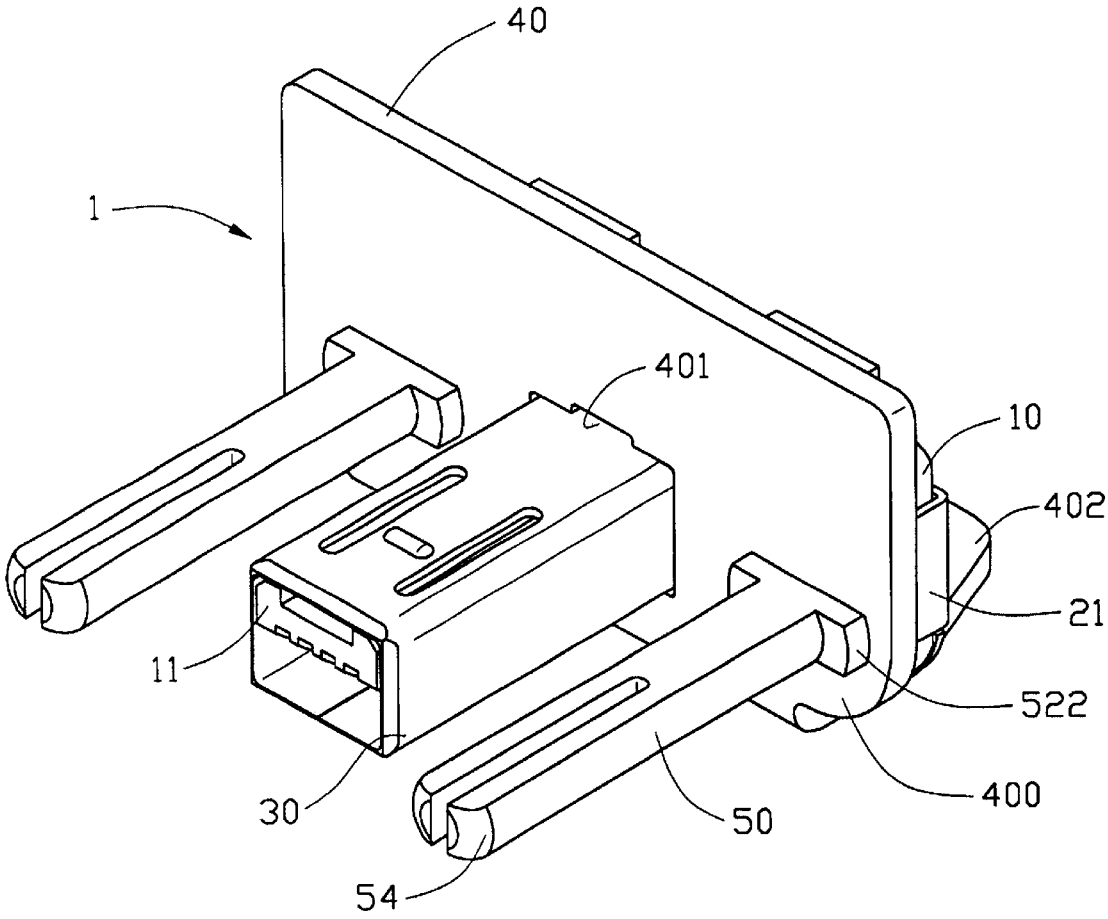
FIG. 2 is an assembled view of FIG. 1.
Figure 3:
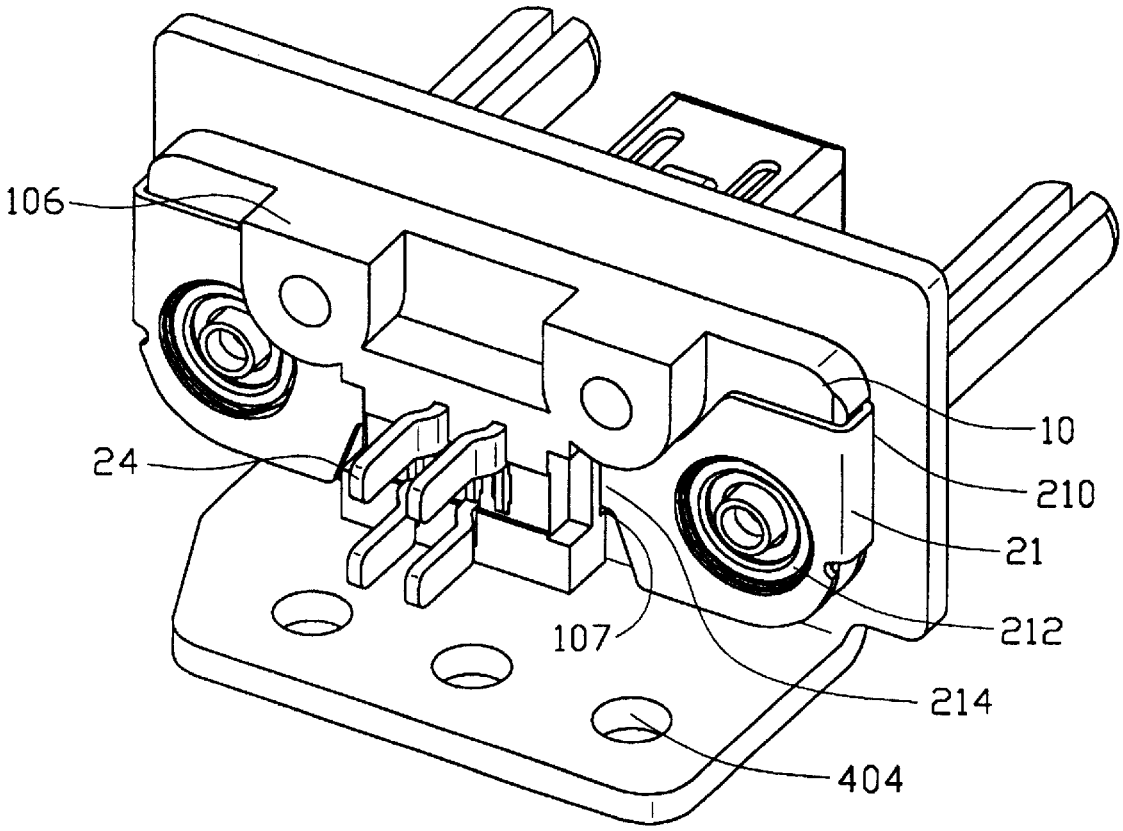
FIG. 3 is a view similar to FIG. 2 but viewed from a rear aspect.

Referring to FIGS. 1 and 2, an electrical connector 1 in accordance with the present invention comprises an insulative housing 10 having a forwardly projecting tongue 11 and a plurality of passageways 110 defined therein, a plurality of terminals 20 for being received in the passageways 110, two grounding plates 21, a shield 30 for enclosing the tongue 11 of the housing 10, a bracket 40 for supporting the insulative housing 10, and two metal latches 50 for assembling the above components together. The passageways 110 are defined through a main portion 12 of the housing 10, and extend along a bottom surface of the tongue 11. Three grooves 100 are defined in a front surface of the main portion 12 at a top of and at both sides of the tongue 11. A through hole 102 is defined in the main portion 12 adjacent to each lateral end thereof. A recess 104 is defined at each lateral edge of the main portion 12. A projection 106 extends rearward from the main portion 12 and defines two inwardly extending slots 107 (see FIG. 3) oriented perpendicularly to the passageways 110. Each slot 107 is adapted for engaging with the grounding plate 21.

Each grounding plate 21 has an ear 210 for engaging with the recess 104 of the housing 10, and an insertion portion 214 for engaging with the slot 107 of the housing 10. A hole 212 is defined in a central portion of the grounding plate 21.

Each terminal 20 includes a mating section 22 at a front end thereof, a soldering section 24 at a rear end thereof, and an interferential section 26 therebetween. The interferential section 26 is for interferentially engaging with the insulative housing 10, thereby securing the terminal 20 in position.

The shield 30 has a rectangular shape for enclosing the tongue 11. Three tabs 300 extend outward from rear edges of the shield 30 to engage with corresponding grooves 100 of the housing 10.

The bracket 40 is L-shaped, and comprises a mating plate 400 and a base plate 402. The base plate 402 defines three apertures 404 (see FIG. 3) for insertion of a securing means to secure the connector to an external body such as a printed circuit board. The mating plate 400 defines an opening 401 for extension of the shield 30 and the tongue 11 therethrough. The mating plate 400 further defines bores 403 at two opposite ends thereof.

Figure 4:
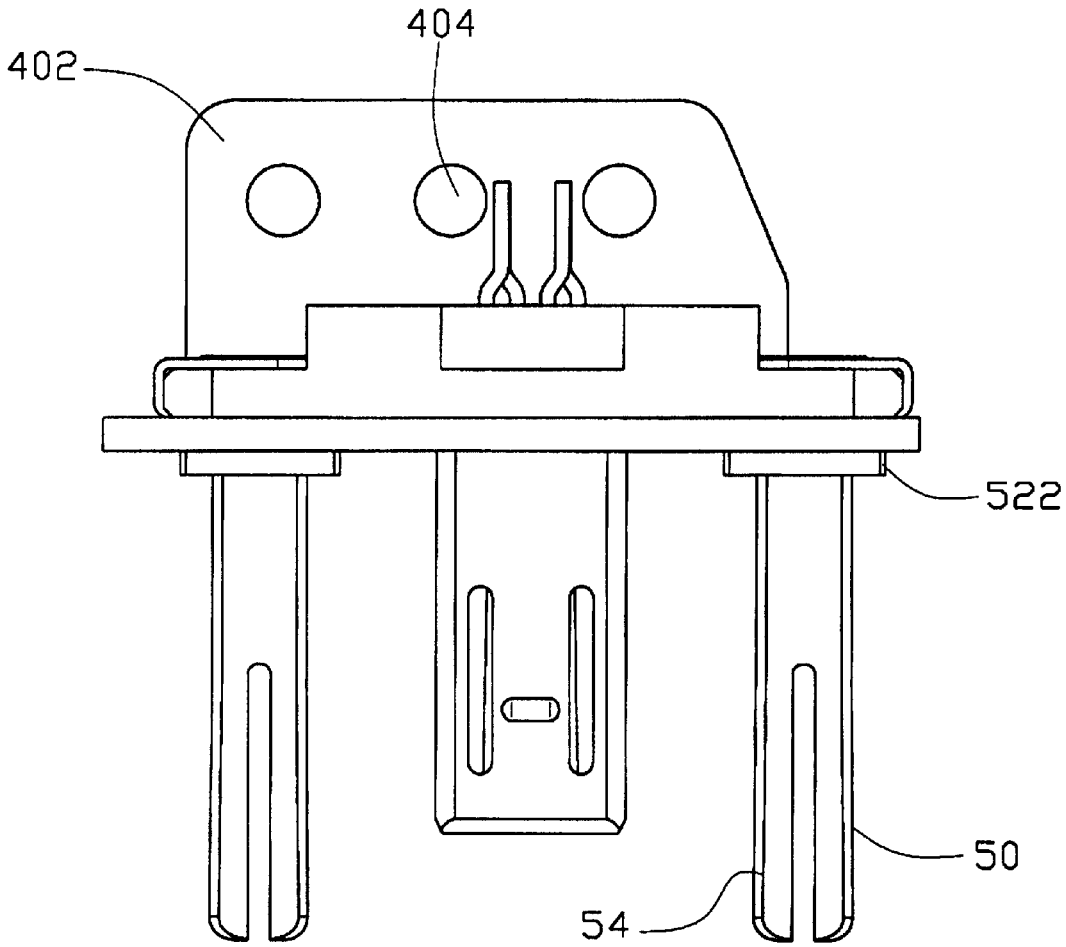
FIG. 4 is a top view of the electrical connector shown in FIG. 2.

Referring to FIGS. 1 and 4, each of the latches 50 comprises a retaining portion 52 at a front end and a coupling portion 54 at a rear end thereof. The coupling portion 54 has two spaced resilient arms 542 divided from a channel (not labelled). The retaining portion 52 has a baffle 522 at a forward end thereof, an engaging section 524 at a middle and a securing section 526 at a rear end thereof, wherein the diameter of the securing section 526 is smaller than that of the engaging section 524.

In assembly, the terminals 20 are inserted into the housing 10 from a rear side of the housing 10, with the soldering sections 24 thereof projecting rearwardly from the housing 10. The shield 30 is slipped over the tongue 11 of the housing 10, the tabs 300 of the shield 30 engaging with the grooves 100 of the housing 10. The grounding plates 21 are engaged with the housing 10, with the ears 210 engaging with the corresponding recesses 104 and with the insertion portions 214 inserted into the corresponding slots 107 (see FIG. 3). The tongue 11 together with the shield 30 are extended through the opening 401 of the bracket 40, and the mating plate 400 abuts the housing 10. The securing section 526 of each latch 50 is sequentially extended through a corresponding bore 403 of the bracket 40, a corresponding through hole 102 of the insulative housing 10 and the hole 212 of a corresponding grounding plate 21 until the engaging section 524 of each latch 50 is engaged with a corresponding bore 403 of the bracket 400, each baffle 522 abuts against a front surface of the mating plate 400, and each securing section 526 projects beyond a rear side of corresponding grounding plate 21. The securing section 526 is finally retained in position by means of a mechanical engagement such as soldering, riveting, or other means.

Thus the bracket 40, the shield 30, the insulative housing 10, and the grounding plates 21 are fixed together via the latches 50. During mating with a complementary connector, the resilient arms 542 of the latches 50 guide the mating electrical connector into correctly aligned engagement with the electrical connector 1. The resilient arms 542 also provide resilient force to retain the electrical connector 1 and the complementary connector in the mated position. In addition, the latches 50 can electrically conduct with the bracket 40, and then increase the efficiency of the grounding for the electrical connector 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mating with a complementary connector, comprising:

an insulative housing having a plurality of passageways therein;

a plurality of terminals being received in the passageways; and at least one latch, each having a retaining portion being retained in the insulative housing and a coupling portion, wherein the coupling portion comprises resilient arms for guiding and retaining the electrical connector to the complementary connector during mating;

wherein each retaining portion of the latch has a baffle to prevent the latch from over-inserting, and a securing section positioned in the housing, an engaging section is located between the baffle and the securing section, and the diameter of the securing section is smaller than that of the engaging section;

wherein the insulative housing defines at least a through hole for extension of the securing section therethrough;

further comprising a shield enclosing a forwardly projecting tongue of the insulative housing, at least a grounding plate attached to a rear side of the insulative housing for enhancing grounding performance, and a bracket for supporting the insulative housing;

wherein the plurality of passageways are defined in the tongue of the insulative housing;

wherein the bracket defines an opening for extension of the tongue therethrough;

wherein a recess is defined in at least a lateral edge of the insulative housing, and at least a slot is defined in the insulative housing adjacent to the passageways;

wherein one end of the at least one grounding plate is received in the at least one slot, while the other end of the at least one grounding plate is engaged with at least one recess;

wherein the at least one grounding plate further defines a hole for allowing extension of the at least one latch therethrough;

wherein the resilient arms are spaced from each other by a channel extending from a free end of the latch.

* * * * *